United States Patent [19]

Ogura et al.

[11] Patent Number: 4,694,440

[45] Date of Patent: Sep. 15, 1987

[54] UNDERWATER ACOUSTIC WAVE TRANSMITTING AND RECEIVING UNIT

[75] Inventors: Koji Ogura; Hideo Sobue, both of Aichi, Japan

[73] Assignee: NGK Spark Plug Co., Ltd., Aichi, Japan

[21] Appl. No.: 722,473

[22] Filed: Apr. 12, 1985

[30] Foreign Application Priority Data

May 4, 1984 [JP] Japan ..... 59-89916

[51] Int. Cl.[4] ..... H04R 1/17

[52] U.S. Cl. ..... 367/152; 367/157; 367/160; 367/166

[58] Field of Search ..... 367/166, 171, 152, 141, 367/155, 157, 160, 161

[56] References Cited

U.S. PATENT DOCUMENTS

| | | | |
|---|---|---|---|
| 2,545,101 | 3/1951 | Meunier | 367/155 X |
| 3,018,466 | 1/1962 | Harris | 310/337 X |
| 3,346,838 | 10/1967 | Johnson, III et al. | 367/157 X |
| 4,081,786 | 3/1978 | Richard | 367/160 |
| 4,173,009 | 10/1979 | Toda | 367/152 X |
| 4,278,000 | 7/1981 | Saito et al. | 310/367 X |
| 4,618,240 | 10/1986 | Sakurai et al. | 355/3 FU |

*Primary Examiner*—Charles T. Jordan
*Assistant Examiner*—John W. Eldred
*Attorney, Agent, or Firm*—Sughrue, Mion, Zinn, Macpeak & Seas

[57] ABSTRACT

An underwater acoustic wave transmitting and receiving unit having excellent characteristics for both transmitting and receiving and providing stable characteristics over long operating periods. A plate-shaped polarized piezoelectric resonator is provided formed of at least one plate made of a complex of fluorosilicon rubber and lead titanate. The resonator is sealed in a rubber casing filled with an insulating liquid matching the water around the casing in acoustic impedance.

2 Claims, 4 Drawing Figures

UNDERWATER ACOUSTIC WAVE TRANSMITTING AND RECEIVING UNIT

BACKGROUND OF THE INVENTION

The present invention relates to an underwater acoustic wave transmitting and receiving unit in which a plate-shaped resonator made of compound piezoelectric material is sealed in a rubber casing which is filled with an insulating liquid matching the surrounding water in acoustic impedance.

A polarized lead titanium zirconate compound is extensively employed as a piezoelectric resonator. If such a resonator is implemented as a plate-shaped resonator in a underwater acoustic wave transmitting and receiving unit, the resonator is well suited for transmitting acoustic waves. However, the resonator is not suitable for receiving waves because the waves are greatly reflected by the surface of the resonator.

SUMMARY OF THE INVENTION

Eliminating this difficulty, the invention provides an underwater acoustic wave transmitting and receiving unit including a resonator which is made of a complex of fluorosilicon rubber and a piezoelectric ceramic such as lead titanate.

DESCRIPTION OF THE PREFERRED EMBODIMENTS

The invention provides an improved resonator of the above-described type, thereby providing an underwater acoustic wave transmitting and receiving unit having excellent characteristics.

The invention will be described with reference to a preferred embodiment shown in the accompanying drawings.

Figure 1:
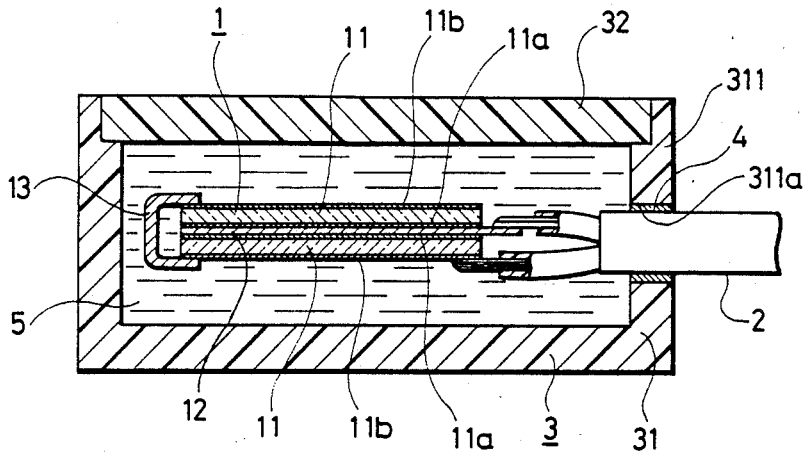
FIG. 1 is a vertical sectional view showing an underwater acoustic wave transmitting and receiving unit of the invention.

In FIG. 1, reference numeral 1 designates a piezoelectric resonator. The resonator 1 includes a pair of piezoelectric elements 11, each having electrode layers 11*a* and 11*b* which are formed on respective main surfaces of the element by application of electrically conductive paste or the like. An electrode plate 12 is disposed between the confronting electrode layers 11*a*, which are positive electrode layers. A connecting member 13 connects the other, outer electrode layers 11*b* of the pair of piezoelectric elements.

Each piezoelectric element 11 is a complex manufactured by forming a mixture of fluorosilicon as a polymer and lead titanate powder into a plate, subjecting the resulting plate to vulcanization and polarization, and forming the electrodes on both main surfaces of the plate.

Further in FIG. 1, reference numeral 2 designates a cable having two conductors which are respectively connected to the electrode plate 12 of the piezoelectric resonator 1 and one of the electrode layers 11*b*, and reference numeral 3 designates a rubber casing which has a body 31 having a small hole 311*a* in its wall 311 through which the cable 2 passes. A cover 32 seals the body 31. The piezoelectric resonator 1 is placed in the body 31. After the cable 2 is passed through the small hole 311*a* in the wall of the body, the small hole 311*a* is water-tightly closed with adhesive 4. The conductors of the cable 2 are connected to the piezoelectric resonator as described above. Thereafter, the body 31 is filled with insulating liquid 5, such as an oil matching the external water in acoustic impedance.

The plate-shaped piezoelectric resonator may be constructed with one piezoelectric element without the electrode plate. In this case, the conductors of the cable are connected to the electrode surfaces on the opposite sides of the piezoelectric element. The resonator and the rubber casing may be circular or rectangular in horizontal section.

The reason why lead titanate is employed as the piezoelectric ceramic component of the piezoelectric resonator is that its dielectric constant is small while providing a high sensitivity for underwater use. The ratio of lead titanate to fluorosilicon is preferably 40 to 80% by volume. That is, if the ratio of lead titanate to fluorosilicon is beyond 80% by volume, it is difficult to form a mixture of fluorosilicon and lead titanate powder into a plate. Contrary to that, if the ratio of lead titanate to fluorosilicon is less than 40% by volume, a sufficient high sensitivity for underwater use is not obtainable.

An example of a piezoelectric resonator of the invention was fabricated as follows: A mixture of 100 g of fluorosilicon rubber (Toshiba Silicon, EQE-24U) and 848 g lead titanate powder (40:60 in volume ratio) was rolled to form a sheet 2 mm in thickness. The sheet thus formed was blanked to obtain a smaller sheet of size $10\times10$ cm$^2$. The sheet thus obtained was vulcanized under pressure at 220° C. for 20 minutes, and then vulcanized under atmospheric pressure at 200° C. for five hours. Silver electrodes were formed on both sides of the sheet thus treated, and then polarization was carried out under 20 kV for one hour. The physical and mechanical characteristics, the electrical characteristics, and the oil resistance of the piezoelectric resonator thus formed were as indicated Table 1 below.

TABLE 1

| Item | Piezoelectric resonator of the invention | Conventional resonator (polychloroprene rubber) | Remarks |
|---|---|---|---|
| Physical & mechanical characteristics | | | |
| Specific gravity g/cm$^3$ | 5.24 | 5.28 | |
| Tensile strength kg/cm$^2$ | 25.3 | 22.7 | |
| Elongation % | 48 | 181 | |
| Elastic modulus $10^7$ N/m | 13.4 | 6.1 | |
| Hardness | 93 | 91 | |
| Electrical characteristics | | | |

TABLE 1-continued

| Item | Piezoelectric resonator of the invention | Conventional resonator (poly-chloroprene rubber) | Remarks |
|---|---|---|---|
| Relative dielectric constant | 38 | 42 | |
| tan δ % | 2.0 | 4.0 | |
| Insulation resistance Ω-cm | $1.4 \times 10^{13}$ | $1.3 \times 10^{11}$ | |
| Wave receiving sensitivity OdB = 1∇/1μ Pascal | −202.7 | −200.1 | |
| dh PC/N | 12.4 | 18.5 | |
| gh mv · m/N | 36.9 | 49.7 | |
| $d_{33}$ PC/N | 52 | 69 | |
| $g_{33}$ mv · m/N | 154 | 186 | |
| Oil resistance (Variation rate %) | | | |
| Volume | | | Test piece: |
| Initial value | 0 | 0 | width 70 mm |
| After 72 hrs | +2.4 | +17 | length 20 mm |
| After 480 hrs | +2.5 | +20 | thickness 2 mm |
| Hardness | | | |
| Initial value | 0 | 0 | Immersed in |
| After 72 hrs | <1.0 | 3 | kerosene at |
| after 480 hrs | <1.0 | 5 | room temperature |

A conventional compound piezoelectric material was fabricated for comparison with the piezoelectric resonator of the invention using the following process: A mixture of 100 g of polychloroprene rubber as a polymer and 950 g of lead titanate powder (40:60 in volume ratio) was rolled to form a sheet. The sheet thus formed was subjected to vulcanization and polarization under optimum conditions to obtain a compound piezoelectric material. The physical and mechanical characteristics, the electric characteristics, and the oil resistance of the material thus obtained are also indicated in Table 1.

As is apparent from Table 1, the piezoelectric resonator of a fluorosilicon rubber complex used in the underwater acoustic wave transmitting and receiving unit of the invention had remarkably better electrical characteristics, for instance, tan δ, and oil resistance compared with the conventional resonator made of a complex of polychloroprene rubber and lead titanate. Especially since the variation rate in the oil resistance is reduced to a fraction, the piezoelectric resonator of the invention is able to maintain stable characteristics for long periods.

Figure 2A:
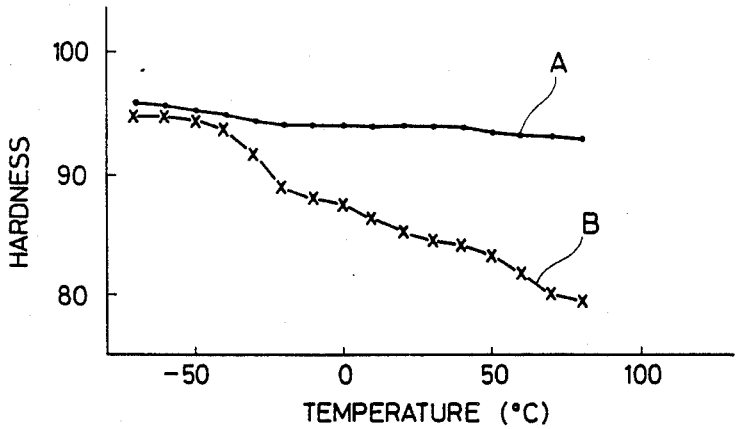
FIGS. 2A, 2B and 2C are graphical representations indicating the temperature characteristics of a fluorosilicon rubber compound piezoelectric resonator used in an underwater acoustic wave transmitting and receiving unit of the invention and those of a conventional polychloroprene rubber compound piezoelectric resonator.
Figure 2B:
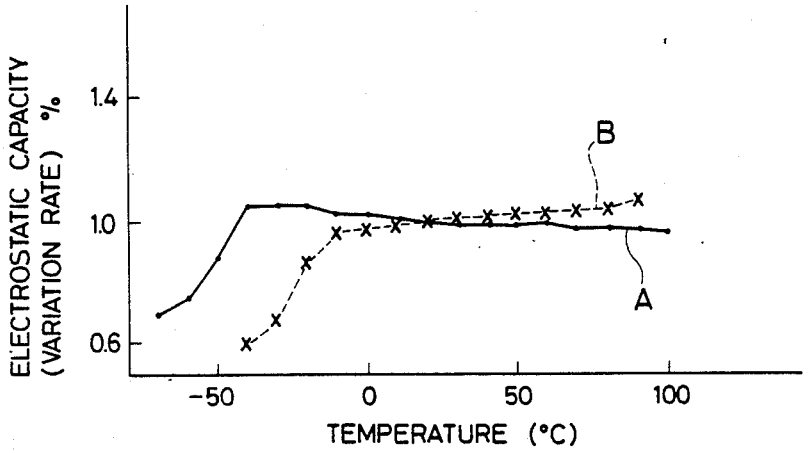
Figure 2C:
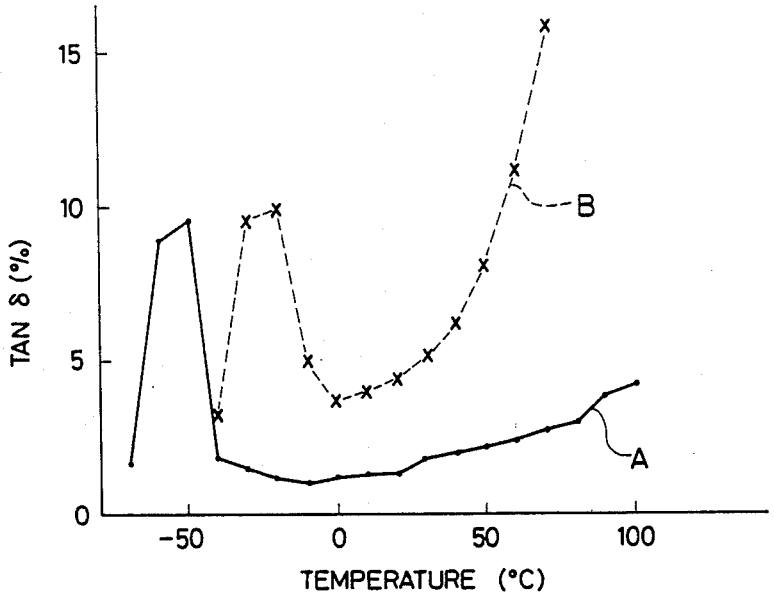

As seen from the hardness, electrostatic capacity (variation rate) and tan δ temperature characteristics shown, respectively, in FIGS. 2A, 2B and 2C, of the compound piezoelectric resonator of the invention and the conventional resonator, the characteristics A of the resonator of the invention are remarkably improved over those B of the conventional device, thereby demonstrating the stability in operation of the underwater acoustic wave transmitting and receiving unit of the invention.

We claim:

1. An underwater acoustic wave transmitting and receiving unit comprising: a plate-shaped polarized piezoelectric resonator comprising at least one plate made of a complex of fluorosilicon rubber and lead titanate; and a rubber casing sealed around said resonator, said casing being filled with an insulating liquid matching water around said casing in acoustic impedance, wherein said plate made of a complex of fluorosilicon rubber and lead titanate is manufactured by the process comprising the steps of: rolling a mixture of lead titanate powder and fluorosilicon rubber in a volume ratio of 40 to 80% of lead titanate to fluorosilicon rubber to form a sheet; blanking said sheet to obtain a smaller sheet; vulcanizing the smaller sheet under pressure; vulcanizing the smaller sheet under atmospheric pressure for a longer period of time than under pressure; forming silver electrode layers on opposite sides of th sheet thus treated; and polarizing the sheet.

2. The underwater acoustic wave transmitting and receiving unit of claim 1, wherein said resonator comprises two said plates made of a complex of fluorosilicon rubber and lead titanate disposed adjacent one another, each of said plates having an electrode layer on both main surfaces thereof, and further comprising an electrode plate disposed between confronting electrode layers of said plates made of a complex of fluorosilicon rubber and lead titanate, and a connecting member connecting outer electrode layers of said plates made of a complex of fluorosilicon rubber and lead titanate.

* * * * *